United States Patent [19]

Tateishi

[11] 4,202,670

[45] May 13, 1980

[54] METHOD FOR PREVENTING SEDIMENTATION OF FINELY POWDERED COAL IN COLLOIDAL FUEL

[75] Inventor: Tetsuya Tateishi, Higashi-Murayama, Japan

[73] Assignee: Agency of Industrial Science & Technology, Ministry of International Trade & Industry, Tokyo, Japan

[21] Appl. No.: 945,102

[22] Filed: Sep. 25, 1978

[30] Foreign Application Priority Data

Sep. 29, 1977 [JP] Japan ..... 52-117009

[51] Int. Cl.[2] ..... C10L 1/32

[52] U.S. Cl. ..... 44/51

[58] Field of Search ..... 44/51; 204/188, 189, 204/19 D

[56] References Cited

U.S. PATENT DOCUMENTS

| | | | |
|---|---|---|---|
| 3,682,807 | 8/1972 | Ishibashi | 204/188 |
| 4,011,843 | 3/1977 | Feuerman | 44/51 |
| 4,133,847 | 1/1979 | Feuerman | 44/51 |

*Primary Examiner*—Winston A. Douglas
*Assistant Examiner*—J. V. Howard
*Attorney, Agent, or Firm*—Kurt Kelman

[57] ABSTRACT

Possible sedimentation of finely powdered coal in colloidal fuel can be effectively prevented by subjecting the colloidal fuel to the action of an electric field and thereby allowing the viscosity of the colloidal fuel to be enhanced owing to the electroviscous effect brought about by the electric field.

2 Claims, 4 Drawing Figures

METHOD FOR PREVENTING SEDIMENTATION OF FINELY POWDERED COAL IN COLLOIDAL FUEL

BACKGROUND OF THE INVENTION

This invention relates to a method for preventing sedimentation of finely powdered coal in a colloidal fuel.

The colloidal fuel is a fuel obtained by having finely powdered coal of a particle size of the order of few microns dispersed in heavy oil. Since the specific gravity of the finely powdered coal is about 1.5 and that of heavy oil is about 0.95, the finely powdered coal gradually settles in the heavy oil with lapse of time by reason of the particle diameter of the dispersed particles (finely powdered carbon), the viscosity of the dispersion medium (heavy oil) and the difference in specific gravity.

With a view to preventing this phenomenon of sedimentation of the powdered coal, there has been proposed a method which involves addition of a surface active agent to the colloidal fuel. Even by this method, the phenomenon of the sedimentation cannot completely be avoided when the colloidal fuel is stored for a long time. There has also been proposed a method which prevents the sedimentation of finely powdered coal by keeping the colloidal fuel in a storage tank in an agitated state by means of a stirrer provided in the bottom portion of the storage tank. For the operation of the stirrer, there must be installed a pump of special design. Otherwise, heavy friction occurs between the pump and the movable mechanical parts of the stirrer which are exposed to direct contact with the colloidal fuel and accelerates wear of the pump and the stirrer.

In view of the general rule that the sedimentation velocity of dispersed particles is inversely proportional to the viscosity of a dispersion medium, it is readily inferred that the sedimentation velocity of the finely powdered coal can be lowered by increasing the viscosity of heavy oil. The simplest way of increasing the viscosity of heavy oil is by lowering the temperature at which the colloidal fuel is stored. This method of increasing the viscosity of heavy oil by lowering its temperature proves to be hardly feasible because of the great cost required for the cooling or heating treatment.

An object of this invention is to provide a method for preventing the sedimentation of finely powdered coal by quickly increasing the viscosity of the colloidal fuel to a specified value and thereby lowering notably the sedimentation velocity of the finely powdered coal.

SUMMARY OF THE INVENTION

To attain the object described above according to the present invention, there is provided a method for preventing the sedimentation of finely powdered coal in the colloidal fuel, which method comprises subjecting the colloidal fuel to the action of an electric field and thereby allowing the viscosity of the colloidal fuel to be increased owing to the electroviscous effect brought about by the electric field and preventing the finely powdered coal from sedimentation.

By this method, therefore, the viscosity of the colloidal fuel can be adjusted to any desired value by suitably controlling the electric potential applied to the colloidal fuel by means of the electric field.

The device which is required for the purpose of this method simply comprises a pair of electrodes and an electric power source for applying the electric potential to the electrodes. This device is simple in construction and, therefore, can readily be applied to existing storage tanks without any difficulty.

Further this method is economical because it solely resorts to the action of an electric field which functions effectively with a very small electric current and consumes only a little power.

The other objects and characteristic features of the present invention will become apparent from the detailed description to be given hereinafter with reference to the accompanying drawing.

DESCRIPTION OF PREFERRED EMBODIMENT

As possible means for increasing the viscosity of heavy oil in the colloidal fuel, the inventor devoted special attention to the nature of colloidal fuel as an electroviscous fluid and conducted a study thereon. Generally, an advantageous condition under which a colloidal suspension of solid-liquid phase behaves effectively as an excellent electroviscous fluid is that the dispersed particles possess a slight degree of electroconductivity and excel in hygroscopicity and further that the dispersion medium possesses a high dielectric constant and exhibits a degree of electroconductivity. The electroviscous effect of the colloidal suspension becomes conspicuous when the dispersed particles in the suspension adsorb a small amount of water.

The colloidal fuel which is produced by having finely powdered coal and a small amount of water dispersed in heavy oil is a suspension that satisfies the aforementioned condition. Thus, the viscosity of this suspension can be increased greatly by causing an external electric field to act upon this suspension. Addition of a small amount of water to the colloidal fuel is advantageous because it serves the purpose of repressing possible release of polluting substances such as $NO_x$ at the time of the combustion of the fuel and, at the same time, enhancing the electroviscous effect and notably increasing the viscosity of the fuel.

Figure 1:
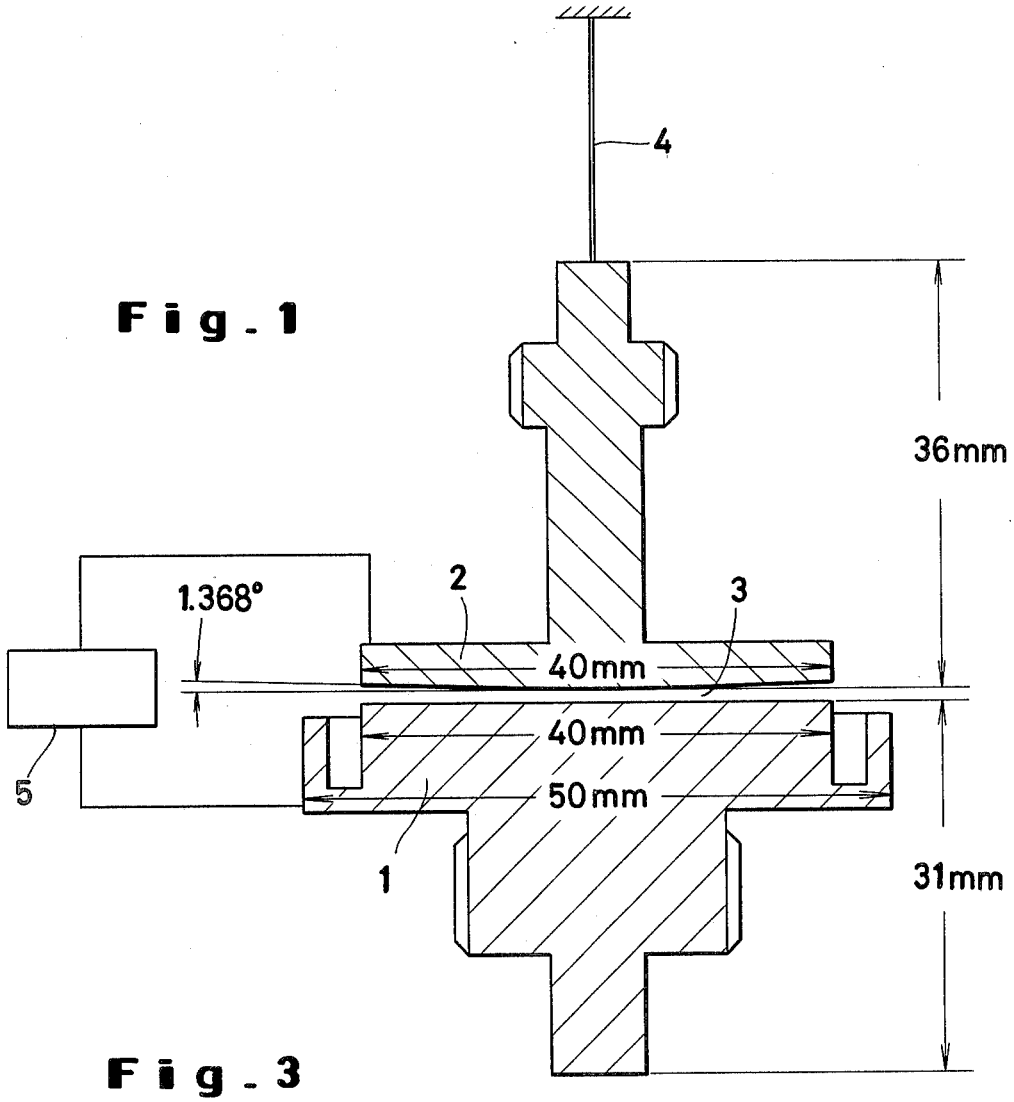
FIG. 1 is a sectioned view of a viscometer to be used for measuring the viscosity of the colloidal fuel.

The inventor has tested the colloidal fuel for its electroviscous effect by means of a cone and plate rotary viscometer of a construction illustrated in FIG. 1. This viscometer is placed in a constant temperature chamber. A sample of the given colloidal fuel is placed in a gap 3 between a rotary disc 1 and an upper cone disc 2. Then the rotary disc 1 is rotated. The torque produced consequently by the rotary disc 1 is transferred through the medium of the intervening layer of the colloidal fuel to the cone disc 2. As the result, the torsion wire 4 which is connected to the supporting shaft of the cone disc 2 is twisted around itself. The viscosity of the colloidal fuel, therefore, can be determined by detecting the angle of this twist in the wire 4 by means of a differential transformer (not shown).

Figure 2:
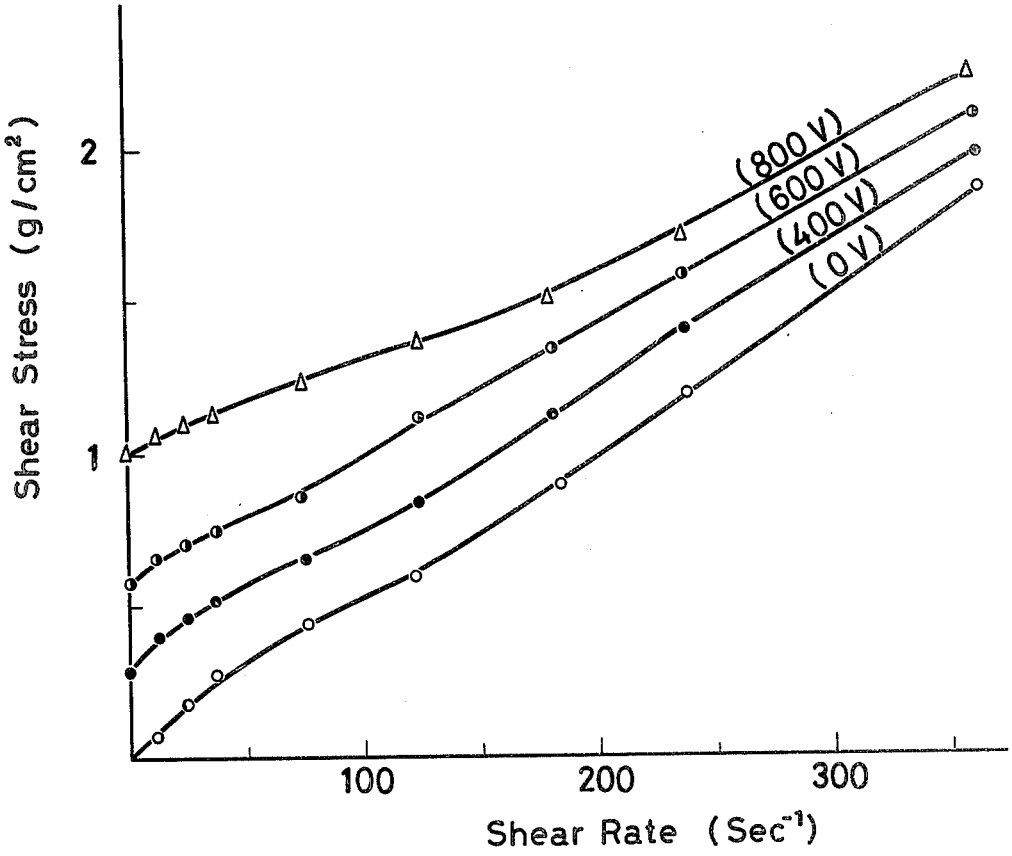
FIG. 2 is a graph showing the relation between the shear rate and shear stress of the colloidal fuel measured by the viscometer of FIG. 1 when the voltage of 0–800 V is applied.

In the viscometer of the aforementioned construction, a colloidal fuel prepared by homogeneously mixing 50% by weight of finely powdered coal, 48.7% by weight of heavy oil, 1.0% by weight of water and 0.3% by weight of an additive was fed into the gap 3 between the rotary disc 1 and the cone disc 2 and maintained at 60° C. Then the rotary disc was set into rotation, with the speed of rotation gradually increased and, at the same time, varying potentials of 0 V, 400 V, 600 V and 800 V were applied from a high-voltage power source 5 between the rotary disc 1 and the cone disc 2, to determine the relation between the shear rate and the shear stress. The results were as shown in the graph of FIG. 2. It is clear from the graph that the shear stress increases especially in the initial phase when the intensity of the electric field increases.

Now, the present invention will be described with reference to the accompanying drawing.

Figure 3:
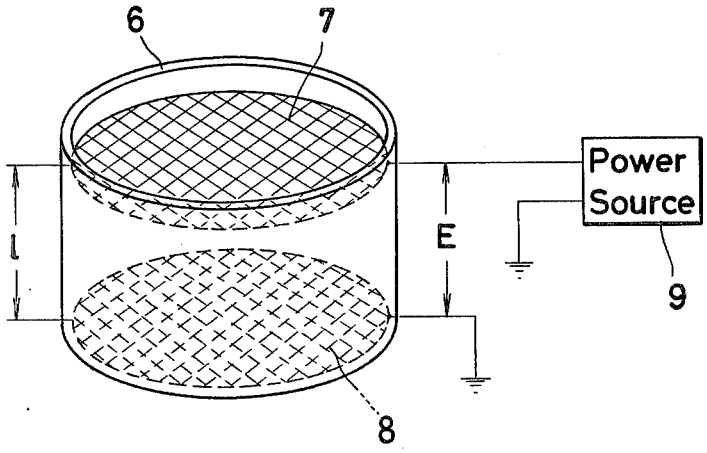
FIG. 3 is a perspective view of one preferred embodiment of the device for working the method of this invention, installed in a storage tank for the colloidal fuel.

FIG. 3 represents one embodiment of the device for preventing possible sedimentation of finely powdered coal according to the method of this invention, which device is used in a storage tank for the colloidal fuel.

With reference to FIG. 3, two electrodes 7, 8 each of the shape of a net are disposed at two horizontally parallel levels separated vertically from each other by a fixed distance "l" within the storage tank 6 and these electrodes are connected to a power source 9 so that a required potential is applied therebetween. The storage tank 6 is ideally made of a fiber-reinforced plastic which has an excellent insulating property. When the electrodes 7, 8 are made of aluminum and electrically insulated by a coat of either Steatite or Alumite, they prove to be highly advantageous because they are light and are capable of precluding hazards of electric leakage, ignition, etc.

Since the colloidal fuel stored in the tank is subjected in its entirety to the action of the electric field, the number of electrodes may be suitably increased in accordance with the size of the storage tank 6.

When a potential "E" from the power source 9 is applied between the electrodes 7, 8 which are disposed at two horizontally parallel levels separated vertically from each other by a fixed distance "l" within the storage tank, an electric field established consequently acts upon the colloidal fuel in the tank. As a result, the viscosity of the colloidal fuel is increased by the electroviscous effect brought about by the electric field.

Generally, the viscosity increases with the increasing magnitude of the potential being applied. For the purpose of this invention, the potential is in the range of from 500 V to 1 KV. In this range of from 500 V to 1 KV, there is no possibility of sparks being thrown off because the dispersion medium has very small electroconductivity (a few mA).

Further, AC potential is preferable to DC potential. When DC potential is applied, there is a possibility that the charged particles are moved toward either of the electrodes by the action of electrophoresis. In order to avoid this, the embodiment shown in FIG. 3 adopts such connection between the power source and the electrodes that the charged particles are moved toward the electrode 7, which connection deprives the charged particles of their gravity and produces no action of electrophoresis to thereby prevent the sedimentation of the particles.

Figure 4:
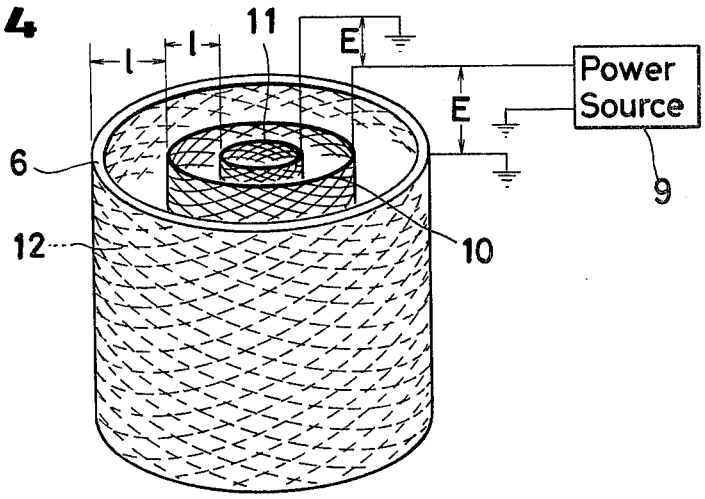
FIG. 4 is a perspective view of another preferred embodiment of the device for working the method of this invention.

FIG. 4 represents another embodiment of the device for working the method of this invention, as applied to a large storage tank. Inside a storage tank 6 which is made of a fiber-reinforced plastic plate having an electroconductive net buried in the outer surface portion thereof, one large and one small cylindrical electrode 10, 11 made of aluminum and insulated with a coat of either Steatite or Alumite are concentrically disposed. The electroconductive net 12 buried in the outer surface portion of the tank 6 is used as an electrode. One of the terminals of a power source 9 is connected to the electrode 10 and the other terminal to the electroconductive net 12 and the electrode 11.

Even when the storage tank to be used has a large size, effective application of the electric field to the entire colloidal fuel stored in the tank can be accomplished advantageously by suitably increasing the number of electrodes. Consequently, the viscosity of the colloidal fuel is increased and the sedimentation velocity of finely powdered coal is lowered.

As is evident from the description given above, the method of the present invention materializes desired prevention of the sedimentation of finely powdered coal in the colloidal fuel by causing an electric field to act upon the colloidal fuel so as to increase the viscosity of the fuel owing to the electroviscous effect brought about by the electric field. Thus, the viscosity of the colloidal fuel can freely be adjusted to a desired level by suitably controlling the intensity of the electric field applied to the fuel. Further, the method of this invention can be carried out by simply having electrodes installed in the storage tank. This means that the method of this invention can easily be applied to existing storage tanks. Since the device thus used for working the method of this invention has no movable mechanical parts, it can be stably operated with a very small power consumption. This invention, therefore, is very economical.

Now, an example of this invention will be cited below.

EXAMPLE

In a tank 100 mm in diameter and 200 mm in height and made of a fiber-reinforced plastic having an electroconductive net buried in the outer surface portion thereof, a cylindrical electrode of aluminum 80 mm in diameter was concentrically disposed. A colloidal fuel made up of about 50% by weight of finely powdered coal, about 48.7% by weight of heavy oil, about 1.0% by weight of water and about 0.3% by weight of an additive was stirred to a homogeneous mixture, placed in the tank mentioned above, maintained at about 70° C. An AC potential 1 KV and 50 Hz was applied between the electroconductive net and the aluminum electrode. After the AC potential was applied for 24 hours, samples of the treated colloidal fuel were collected one each at heights of 20 mm and 180 mm from the bottom and tested for powdered coal concentration. The coal concentration was about 51% for the former sample and about 48.5% for the latter sample. When the colloidal fuel was stored for 24 hours in the same tank without application of the AC potential, the powdered coal concentration was about 65% for the sample taken at the smaller height and about 38% for the sample taken at the greater height, indicating that the sedimentation velocity of powdered coal was much greater in the absence of the treatment by the method of this invention.

What is claimed is:

1. A method for preventing sedimentation of finely powdered coal in a colloidal fuel comprised of the finely powdered coal dispersed in heavy oil and containing a minor amount of water, comprising the steps of immersing insulated electrodes in the colloidal fuel and applying an electric potential of 500 V to 1000 V thereto to create an electric field substantially free of sparks in the colloidal fuel and thereby increasing the viscosity of the colloidal fuel owing to the electroviscous effect brought about by the electric field.

2. The method of claim 1, wherein the colloidal fuel is comprised of about equal parts, by weight, of the heavy oil and finely powdered coal and contains about one part, by weight, of water per hundred parts, by weight.

* * * * *